United States Patent [19]

Brewer

[11] Patent Number: 4,945,741

[45] Date of Patent: Aug. 7, 1990

[54] KEY TAG

[76] Inventor: Robert A. Brewer, 15 Castle Park Way, Oakland, Calif. 94611

[21] Appl. No.: 411,734

[22] Filed: Sep. 25, 1989

[51] Int. Cl.[5] ..... A47G 29/10

[52] U.S. Cl. ..... 70/456 R; 70/459

[58] Field of Search ..... 70/456 R, 456 B, 459; 24/3 R; 150/40

[56] References Cited

U.S. PATENT DOCUMENTS

| | | | |
|---|---|---|---|
| 1,114,289 | 10/1914 | Rittenhouse . | |
| 1,647,140 | 11/1927 | Ludy . | |
| 2,129,436 | 9/1938 | Murray | 70/459 |
| 3,513,675 | 5/1970 | Ryder | 70/459 |
| 3,715,900 | 2/1973 | Sherman | 70/456 |
| 3,956,913 | 5/1976 | Howard | 70/456 |
| 4,024,608 | 5/1977 | Brewer | 24/236 |
| 4,358,944 | 11/1982 | Stoffel | 70/456 |
| 4,419,874 | 12/1983 | Brentini | 70/459 |
| 4,422,315 | 12/1983 | Klose | 70/456 |
| 4,425,772 | 1/1984 | Brewer | 70/456 |
| 4,492,048 | 1/1985 | Brewer | 40/2 |

*Primary Examiner*—Robert L. Wolfe
*Attorney, Agent, or Firm*—James R. Cypher

[57] ABSTRACT

A tag device for holding articles such as keys and for attachment to an organizing member such as a D-ring. All forms of the invention are constructed with a plastic sleeve which has a substantial area for receiving a label or writing to serve to identify the key. In one form of the invention the article is attached to a metal wire member which is releasably retained by the plastic sleeve. In another form, the insert member which holds the article is made of plastic and is releasably held by the sleeve. In still another form of the invention, the insert member is made of plastic and is detachable from the sleeve only with the use of a release tool.

12 Claims, 7 Drawing Sheets

A
24
23
22
9"
7"
29
48'
6"
13"
66'
67'
62
52'
51'
47'
68'
10"
54'
45"
43"
4"
3"
35"
8"
5"
2"
63
61
44"
46"
36"
1"
64
52"
51"

KEY TAG

BACKGROUND OF THE INVENTION

This invention relates to a device which may be attached to an item such as a key, card, disc or any other item which has an opening for attachment purposes and is commonly carried in the pocket or purse of an individual for gaining entry or admittance or simple identification purposes.

A great many different tag devices have been provided in the market place for individuals who wish to provide an identification means for a few number of keys. Because of the small number of keys, different colors, symbols, numbers, or a single word have been sufficient to distinguish the different keys.

With the advent of large organizations hundreds and even thousands of keys are used in the operation of the facilities. These keys are used by hundreds and even thousands of individuals, yet all must be identified and organized by the managers of these large organizations. The amount of information that must be placed on some of these keys is so lengthy and the problem of keeping track of such keys is so laborious that the only simple solution has been the use of computers to store the information and print the key identification on labels which can be attached to the keys.

The labels, of necessity, must be printed on paper and these labels must be protected for long period of time even though the tags are handled daily and carried in pockets and purses.

Present key tag systems generally do not provide enough space for the amount of information which the computers print or cannot adequately protect a paper tape label for a long period of time which is carried and used daily by an individual.

SUMMARY OF THE INVENTION

The gist of the present invention is a device which provides a rigid surface sufficient to receive a paper or plastic tape capable of presenting a significant amount of information.

An object of the present invention is to provide a device which will protect the information for long periods of time even though the key tag is handled daily and carried in a pocket or purse.

A further object is to provide a key tag which is compact and does not tear or unreasonably wear the pocket or purse of the user.

Another object is to provide a key tag which may be economically mass produced.

Another object is to provide a key tag which can be easily modified so that the key cannot be removed from the tag except by the use of a tool.

Still another object is to provide a key tag in which the key cannot be removed without destroying the label.

DESCRIPTION OF THE PREFERRED EMBODIMENTS

Figure 1:
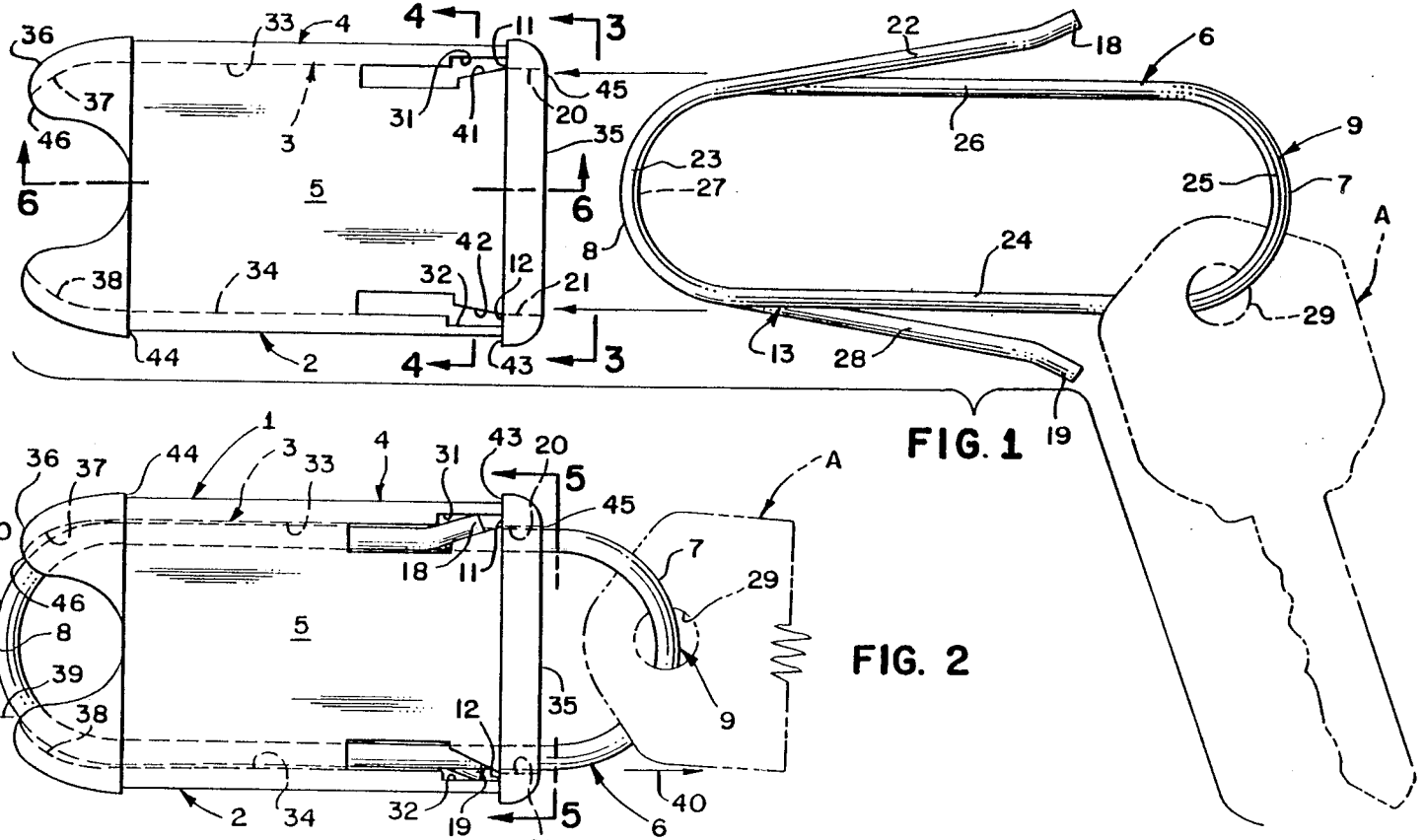
FIG. 1 is an expanded plan view of the preferred form of the invention. A key illustrating the main use of the invention is shown in broken line.

Referring to FIGS. 1-11 of the drawings, the preferred form of the tag device 1 for holding articles "A" such as keys and for attachment to an organizing member "B" such as a split ring consists briefly of an open ended rigid sleeve 2 having inner and outer walls 3 and 4 and having an indicia receiving means 5 on a portion of the outer wall 4; an elongated insert member 6 having first and second ends 7 and 8 dimensioned for receipt within the inner wall 3 of the rigid sleeve 2 and retained by the rigid sleeve 2; article holding means 9 on the first end 7 of the insert member 6; organizer holding means 10 on the second end of the insert member 6; locking means 11 and 12 for preventing movement of the insert member 6 relative to the sleeve 2; and openable gate means 13 provided on the insert member.

Sleeve 2 is preferably made of plastic so that the tag device may be light weight and inexpensive. The plastic sleeve is preferably made of different colors to aid in distinguishing classes of articles to be organized. For example, red could identify keys for one building, and green for another building. The plastic selected preferably may be such as to receive markings of a pen so that the article designation may be marked directly upon the sleeve. Preferably the outer wall of the sleeve should have a relatively large planar area for receiving the writing.

The elongated insert member may be of various materials. It has been found that wire is preferred for tags which are to be carried a substantial part of the time and where maximum compactness and security are required. Plastic is the preferred material where low cost is the most important criteria or where ease in removing the insert member from the sleeve is desired.

Figure 9:
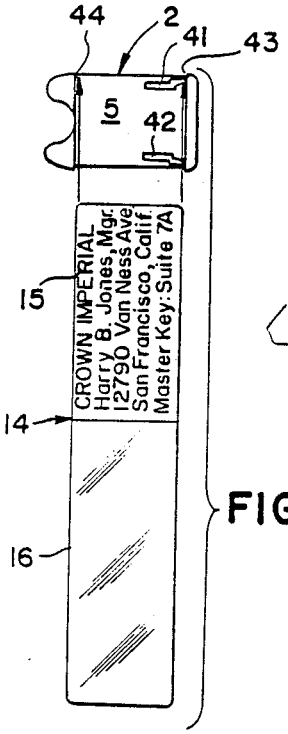
FIG. 9 is a plan view of the device and a paper and plastic tape.
Figure 10:
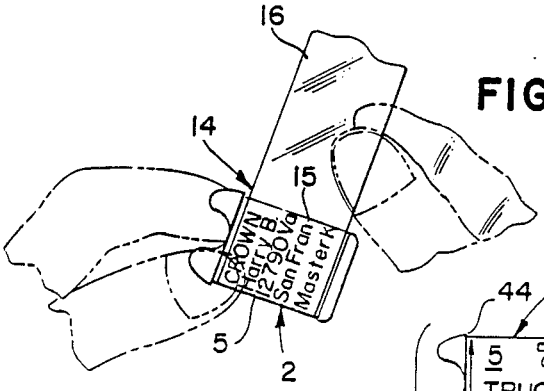
FIG. 10 is a plan view of the device of FIG. 9 illustrating a method of affixing the paper and plastic tape to the device. Portions of a human hand are illustrated in broken line to demonstrate the ease in applying the protective plastic tape to the device.
Figure 11:
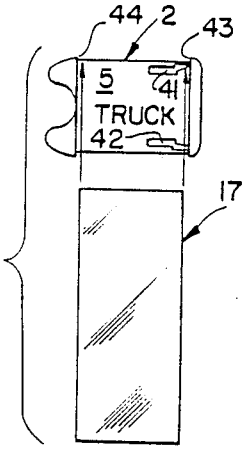
FIG. 11 is a plan view of another method of writing on the device and protecting the writing.
Figures 12, 13:
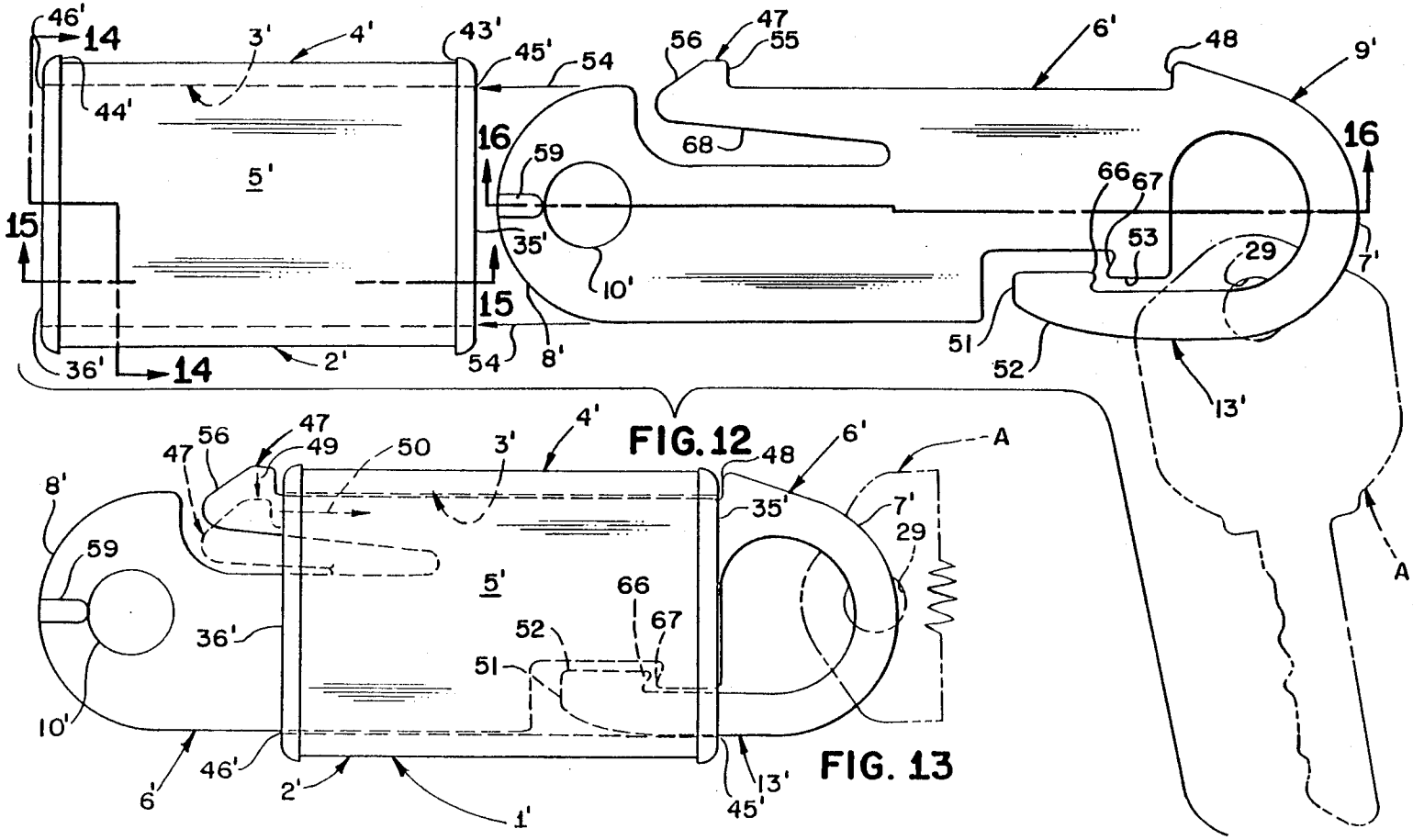
FIG. 12 is an expanded plan view of another form of the invention. A key in broken line is indicated.
FIG 13 is a plan view of the device shown in FIG. 12 in the assembled form. A portion of a key in broken line is illustrated.
Figure 14:
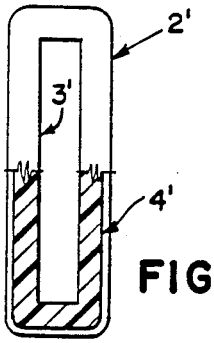
FIG. 14 is an end view partially in section of the device taken along line 14—14 in FIG. 12.
Figure 15:
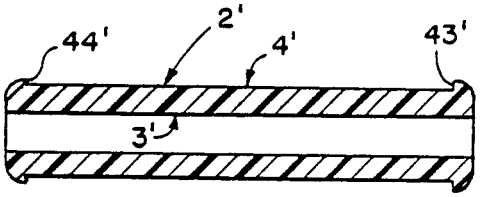
FIG. 15 is a cross section of the device taken along line 15—15 of FIG. 12.

In those instances where a great deal of information is to be placed on an individual tag device, an elongated indicia receiving member 14 dimensioned for placement on the indicia receiving means as illustrated in FIGS. 9–11 is provided. The elongated indicia receiving member 14 is preferably constructed with an indicia receiving portion and a transparent or translucent portion 16. One or both portions of the indicia receiving member 14 may be provided with means for adhering the elongated indicia receiving member 14 to the open ended rigid sleeve member 2.

Thus the indicia information may be printed by computer or other means on portion 15 which is placed in registration with indicia receiving means 5 on sleeve 2. The elongated indicia receiving member 14 is then wrapped around the sleeve as shown in FIG. 10. Elongated member 15 may be constructed with paper in portion 15 and clear Mylar plastic in portion 16.

As illustrated in FIG. 11, the sleeve 2 may be constructed with a portion 5 of the outer wall including a relatively planar surface. If the pen used to mark the sleeve surface is not permanent, it is preferable to cover the indicia with an elongated clear Mylar member only. The clear Mylar member may be constructed with pressure sensitive adhesive so that at the clear Mylar member is wound on the sleeve 2 it will adhere to the sleeve. Wherever the term "Mylar" is used, the term Polyester, Polypropylene, or other plastic tape may be substituted.

Preferably the elongated insert member 6 is constructed from spring metal wire so that the ends 18 and 19 of the wire insert will spring away from each other when released from the confines of restricted sleeve opening walls 20 and 21. Elongated insert member is preferably constructed from a single member consisting of end 18, first diverging portion 22, first loop 23, straight portion 24, second loop 25, second straight portion 26, third loop 27 which is in registration with first loop 23, and second diverging portion.

An article such as key A is placed on insert member 6 by first placing either end 18 or 19 through an opening 29 in the key. If placed on end 18, the key is then slid along first diverging portion 22; around first loop 23 down first straight portion 24 to second loop 25. With first and second diverging portions 22 and 28 sprung apart, key A will not separate from the elongated insert member 6.

The locking means 11 and 12 for preventing movement of the insert member 6 relative to the sleeve 2 consists of a shoulder on the inner wall of the sleeve which is also designated by the numbers 11 and 12. Shoulders 11 and 12 may be formed by forming indentations 31 and 32 in edges 33 and 34 of inner wall 3 of sleeve 2.

Figure 3:
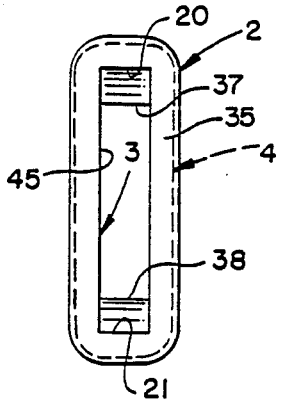
FIG. 3 is an end view of the device shown in FIG. 1 taken along line 3—3 of FIG. 1.
Figure 4:
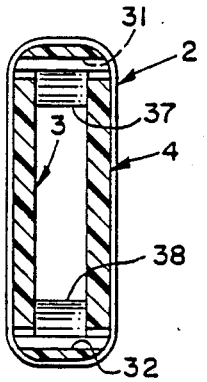
FIG. 4 is a sectional view taken along line 4—4 of FIG. 1.
Figure 5:
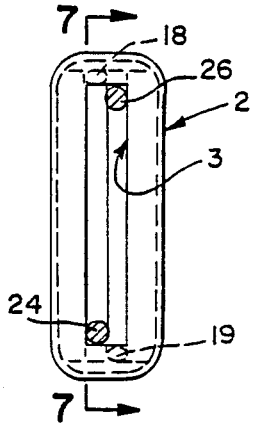
FIG. 5 is an end view of the device shown in FIG. 2 taken along line 5—5 of FIG. 2.
Figure 6:
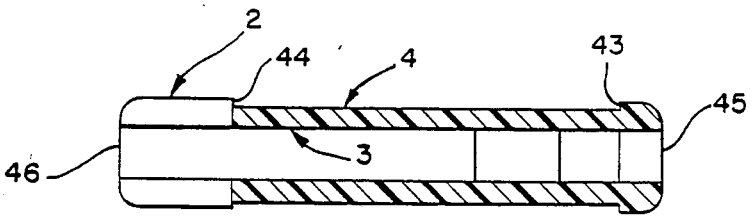
FIG. 6 is a cross sectional view taken along line 6—6 of FIG. 1.
Figure 7:
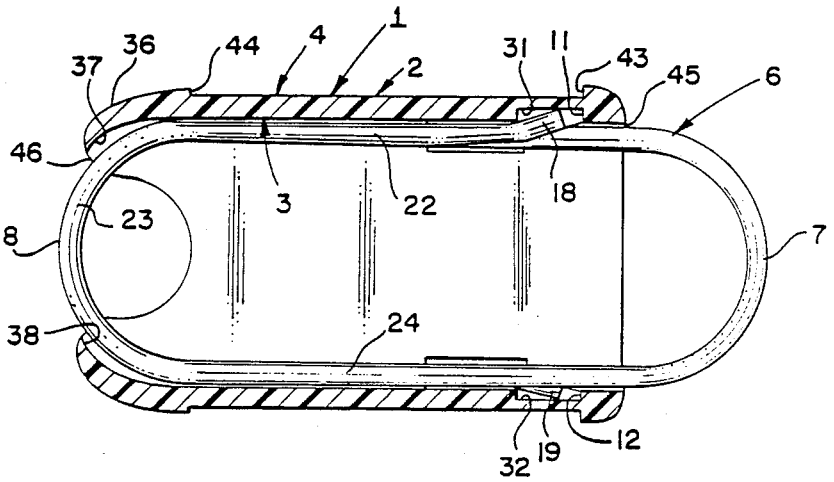
FIG. 7 is a cross sectional view taken along line 7—7 of FIG. 5.

Open ended rigid sleeve 2 is formed with a first end 35 having a first end opening 45 dimensioned for receiving the second end 8 of insert member 6 and a second end 36 formed with a smaller second end opening 46 preventing passage of the second end 8 of insert member 6 therethrough. As shown in FIGS. 1, 3 and 4, the restriction in second end opening 46 may be formed by simply curving ends 37 and 38 of edges 33 and 34 of inner wall 3 inwardly.

As illustrated in FIG. 1, insert member 6 is constructed from a single piece of wire and first and second diverging portions 22 and 28 extend along a substantial portion of each of the lengths of first and second straight portions 24 and 26.

When an article such as key. A has been inserted onto elongated member 6 as previously described, second end 8 of insert member 6 is inserted into first end 35 of sleeve 2 until first and third loops 23 and 27 are adjacent ends 37 and 38 of edges 33 and 34 of inner wall 3. First and second diverging portions 22 and 28 will be compressed toward one another by restricted sleeve opening walls 20 and 21. When insert member ends 18 and 19 clear shoulders 11 and 12, ends 18 and 19 will snap outwardly into indentations 31 and 32. Thus ends 37 and 38 prevent movement of insert member 6 in the direction of arrow 39 and shoulders 11 and 12 prevent insert member 6 from moving in the direction of arrow 40.

In order to release insert member 6 from sleeve 2, it is necessary to compress insert member ends 13 and 19 simultaneously inwardly by means of a tool (not shown). To permit insertion of a tool, the sleeve member 2 is preferably formed with a pair of openings 41 and 42 in registration with the opposite ends 18 and 19 of insert member 6. These openings are dimensioned to permit a tool to be inserted for compressing ends 18 and 19 inwardly so that they will clear shoulders 11 and 12 when insert member is pulled in the direction of arrow 40.

Elongated clear Mylar portion 16 as illustrated in FIG. 9 and Mylar member 17 illustrated in FIG. 11 also serve to prevent tampering. The Mylar member covers tool openings 41 and 42 in sleeve members 2 to prevent insertion of a tool to compress ends 18 and 19 of the wire insert member 6. If the Mylar tape member 16 or 17 is punctured or removed, it is almost impossible to replace without indicating that tampering has occurred.

Figure 8:
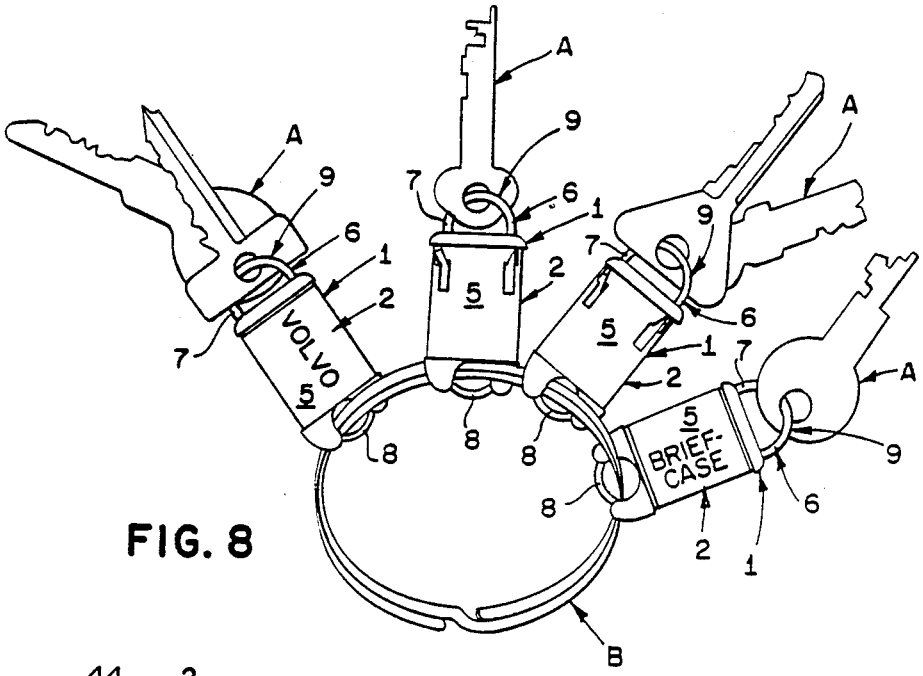
FIG. 8 is a plan view of the device of FIG. 1 illustrating the attachment of the devices to a split ring.

It is almost impossible for a key to become separated from the sleeve 2 and insert member 6. When the tag device is connected to a split ring B as shown in FIG. 8, the split ring prevents the insert member 6 from separating from the sleeve 2. Moreover, even when the tag device 1 is not connected to a split ring B, and should the insert member somehow become separated from the sleeve 2, as shown in FIG. 1, the key A will still remain connected to the insert member 6.

In one form of the invention, the sleeve member 2 is formed so that the indicia receiving means 5 is indented with respect to the first and second ends 35 and 36. This forms annular shoulders 43 and 44 which assist in protecting and holding Mylar members 16 and 17 on the sleeve 2.

Another feature of the tag device is the careful structuring of second end 36 of the sleeve member 2. It was stated earlier that elongated insert member 6 is formed with a single loop 25 at first end 7 and and double loops 23 and 27 at second end 8. Opening 46 is dimensioned so that the double loops 23 and 27 are snugly held by inner wall 3 of the sleeve so that there is little or no space between the wall of the sleeve and the insert member. In addition second end 36 is rounded so that clothing or other articles do not catch between the sleeve and the insert member 6.

Another form of the invention is illustrated in FIGS. 12–19. Similar or identical parts are indicated by the same numbers used in FIGS. 1–11 of the illustrations with the addition of the prime symbol (′). Different parts are identified by new numbers.

Referring to FIGS. 12–19 of the drawings, the tag device 1′ for holding articles "A" such as keys and for attachment to an organizing member "B" such as a split ring consists briefly of an open ended rigid sleeve 2′, having first and second ends 35′ and 36′, inner and outer walls 3′ and 4′, and an indicia receiving means 5′ on a portion of the outer wall 4′; an elongated insert member 6′ having first and second ends 7′ and 8′ dimensioned for receipt within the inner wall 3′ of the rigid sleeve 2′ and including a spring latch member 47 releasably engaging the second end 36′ of the rigid sleeve member 2′ and a stop member 48 for engaging the first end 35′ of the rigid sleeve member 2′ acting in combination for preventing movement of the insert member 6′ relative to the sleeve 2′; article holding means 9′ on the first end 7′ of the insert member 6′; organizer holding means 10′ on the second end 8′ of the insert member 6′; and openable gate means 13′ provided on the first end 7′ of the insert member 6′. Spring latch means 47 includes a lever arm 68.

Sleeve 2′ is preferably made of plastic, such as an ABS plastic, so that the tag device may be light weight and inexpensive. The plastic sleeve is preferably made of different colors to aid in distinguishing classes of articles to be organized. For example, red could identify keys for one building, and green for another building. The plastic selected preferably may be such as to receive markings of a pen so that the article designation may be marked directly upon the sleeve. Preferably the outer wall of the sleeve should have a relatively large planar area for receiving the writing.

The alternate form of the invention is primarily designed for users who wish to occasionally remove or change keys. To effect this, spring latch member 47 is moved in the direction of arrow 49 illustrated in FIG. 13 and then insert member 6′ is moved in the direction of arrow 50 until end 51 of pivot member 52 of openable gate means 13′ clears first end opening 45′ of sleeve 2′. Pivot member 52 of openable gate means 13′ is then moved transversely to the plane of insert member 6′ until there is sufficient space between pivot member 52 and edge 53 of insert member 6′ to slide the opening 29 of key A along pivot member 52 until it clears end 51 and is released.

Another key may be placed on the insert member 6′ if desired merely by reversing the procedure. The insert member is then moved in the direction of arrows 54 illustrated in FIG. 12 until shoulder 55 of spring latch member 47 clears second end opening 46′ and springs outwardly to the solid line position illustrated in FIG. 13.

Figure 2:
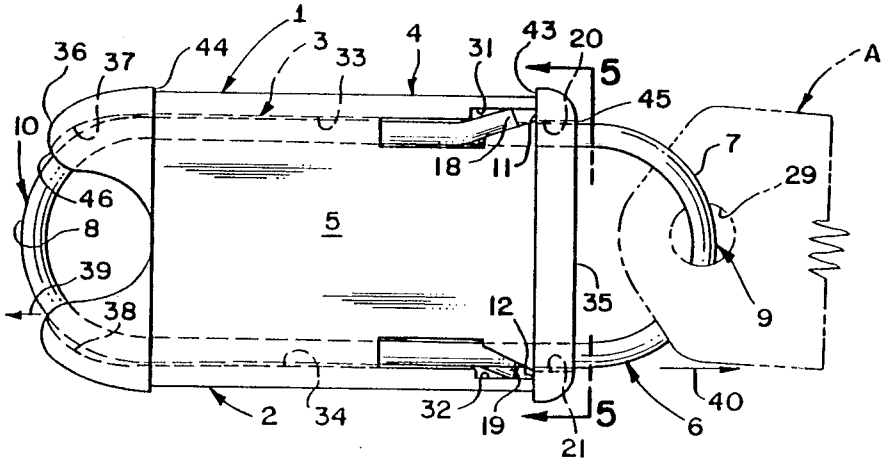
FIG. 2 is a plan view of the device shown in FIG. 1 with the insert member within the sleeve member in the locked position. A portion of a key is shown in broken line.

To assist in the insertion of the elongated insert member 6′ into first end opening 45′ in sleeve 2′ and to automatically depress the spring latch member 47, a cam surface 56 is formed at the outer end and is dimensioned to engage the edge of first end opening 45′ when moved in the direction of arrow 54 as illustrated in FIG. 2.

Figure 16:
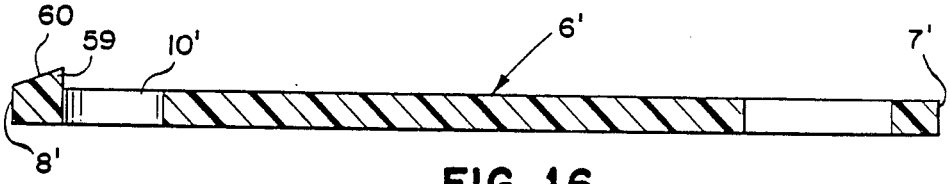
FIG. 16 is a cross section of the device taken along line 16—16 of FIG. 12.
Figure 17:
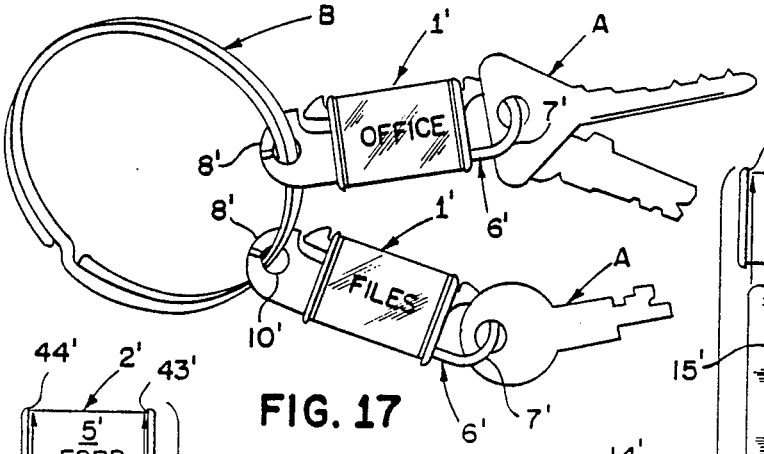
FIG. 17 is a plan view of the device shown in FIG. 12 attached to a split ring holder.

To prevent separation of the insert member 6′ from the sleeve 2′, a stop 59 may be formed to protrude from the face of second end 8′ of insert member 6′ and catch on second end 36′ of sleeve 2′. In order that stop 59 does not interfere with the initial insertion of insert 6′ into sleeve 2′, stop 59 may be formed with an inclined face 60 as illustrated in FIG. 16. To prevent unlatching of gate means 13′, pivot member 52 is formed with a protrusion 66 which engages shoulder 67.

Figure 18:
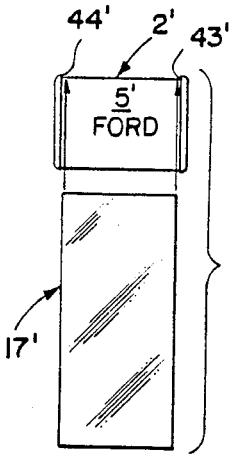
FIG. 18 is a plan view of a portion of the device shown in FIG. 12 with a protective plastic tape.
Figure 19:
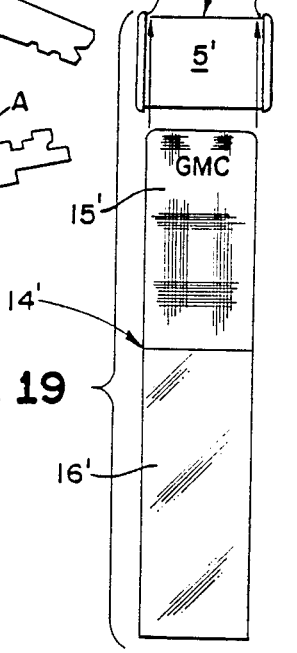
FIG. 19 is a plan view of a portion of the device shown in FIG. 12 shown with a modified labeling tape and protective plastic member.

Sleeve 2′ may be marked with a pen in the same manner as sleeve 2 illustrated in FIGS. 1–11. As illustrated in FIG. 18, a protective Mylar member 17′ or simply a piece of Scotch tape may be placed on the indicia receiving means 5′ and wound around the sleeve member 2′ Shoulders 43′ and 44′ on sleeve 2′ assist in protecting the Mylar tape and to hold it in place. As illustrated in FIG. 19, elongated indicia receiving member 14′ having an indicia receiving portion 15′ and a transparent or translucent portion 16′ may be used to identify the tag device 1′. Writing is placed on the indicia receiving portion 15′ and adhered to the indicia receiving means 5′ on sleeve 2′. The elongated indicia receiving member 14′ is then wound about the sleeve 2′.

Still another form of the invention is illustrated in FIGS. 20–26. The device illustrated has been given numbers followed by a double prime mark (″) where the part is similar or identical to a part illustrated in FIGS. 1–11, and a single prime mark (′) where the part is similar to or identical to a part illustrated in FIGS. 12–19. Parts which are not similar or identical to either of the two previous forms of the invention have been given a new number. For purposes of brevity, description of parts which are similar or identical to parts in the previous forms of the invention are not repeated.

The device illustrated in FIGS. 20–26 is designed so that keys, once attached, cannot be removed without either destroying the tag device or using tools with great care. Even then, the label must be destroyed or mutilated. This prevents or strongly discourages removal of the keys from the tag device, since the tampering is easily detectable. The ample capacity for type written or computer-lettered messages on the label makes it plausable to include lines such as; "Do not Remove Tag from Key", "Return Key to Security Clerk", or other messages to impress on the employee or key borrower the security importance of the key.

The tag device 1″ of FIGS. 20–26 consists briefly of an open ended rigid sleeve 2″ having inner and outer walls 3″ and 4″ and formed with an indicia receiving means 5″ formed in the outer wall 4″ and a catch means 61 formed in the inner wall 3″; an elongated insert member 6″ having first and second ends 7″ and 8″ releasably retained by and separable from the rigid sleeve; article holding means 9″ on the first end 7″ of the insert member 6″; a spring latch member 47′ including lever arms 68′ mounted on the elongated insert member 6″ having a spur 62 for engagement with the catch means 61 for preventing movement of the insert member 6″ relative to the sleeve 2"; and openable gate means 13" provided on the first end 7" of the insert member 6".

Where it is desirable to occasionally remove a key from the tag device, an opening 63 is formed in the rigid sleeve member 2" in registration with the spring latch member 47' when the insert member 6" is inserted into the rigid sleeve member 6" and dimensioned for receiving a tool for unlatching the latch member 47' and permitting separation of the rigid sleeve member 2" and the insert member 6".

Figures 20, 21:
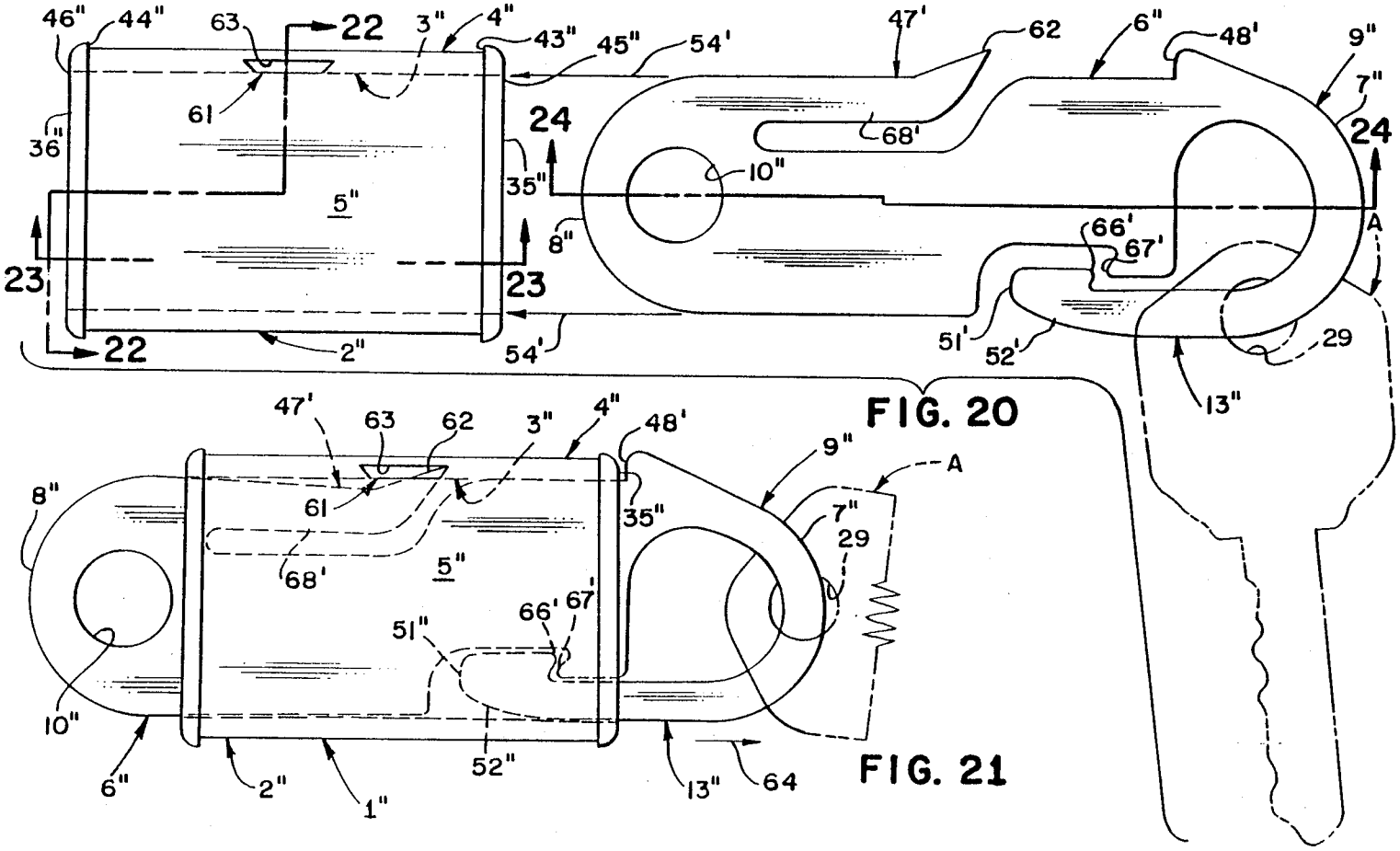
FIG. 20 is a plan view of still another form of the invention. A key is shown in broken line.
FIG. 21 is a plan view of the device shown in FIG. 21 in the assembled form. A portion of a key is shown in broken line.
Figure 22:
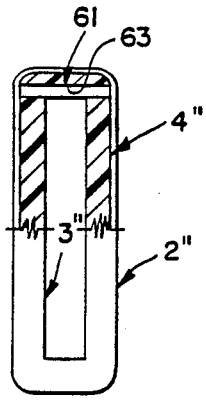
FIG. 22 is an end view in partial section of the device illustrated in FIG. 20 taken along line 22—22 of FIG. 20.
Figure 23:
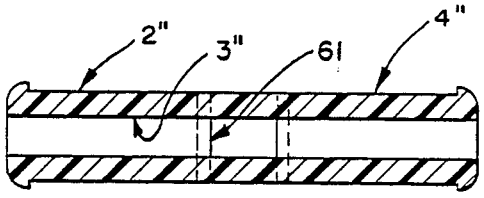
FIG. 23 is a cross sectional view of a portion of the device shown in FIG. 20 taken along line 23—23 of FIG. 20
Figure 24:
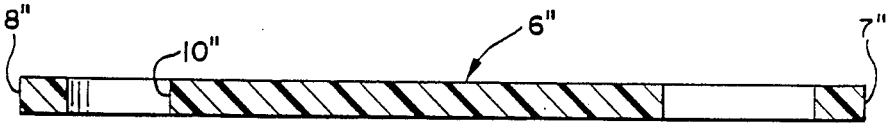
FIG. 24 is a cross sectional view taken along line 24—24 in FIG. 20.

Sleeve 2" as illustrated in FIGS. 21 and 22 is formed with a catch means 61 in only one edge. This construction enables the insert 6" to be "parked" in the sleeve before attachment of a key by inserting it with the spur 62 on the opposite side of the sleeve from the catch means 61. When the user is ready to attach the key, he can slide the insert member 6" out of sleeve 2", flex the openable gate means 13" to one side of the plane of the insert member, pass the pivot member 51' through opening 29 in key "A", and reinsert insert member 6" in the sleeve 2" with the spur 62 on the same edge of the sleeve 2" as the catch means 61 until the spur 62 on spring latch member 47' snaps in place as illustrated in FIG. 21 and locks the insert member 6" in sleeve 2". Stop member 48' on first end 7" of insert member 6" abutting first end 35" of sleeve 2" prevents insert member 6" from moving in the direction of arrows 54' as illustrated in FIG. 20. Thus, the insert member 6" and sleeve 2" are locked together.

If it is desired to remove the key from insert member 6", it is necessary to insert a tool (not shown) into opening 63 and force the spur 62 away from catch means 61. While continuing to exert pressure on the spur 62, insert member 6' must be moved in the direction of arrow 64 in FIG. 21.

Figure 25:
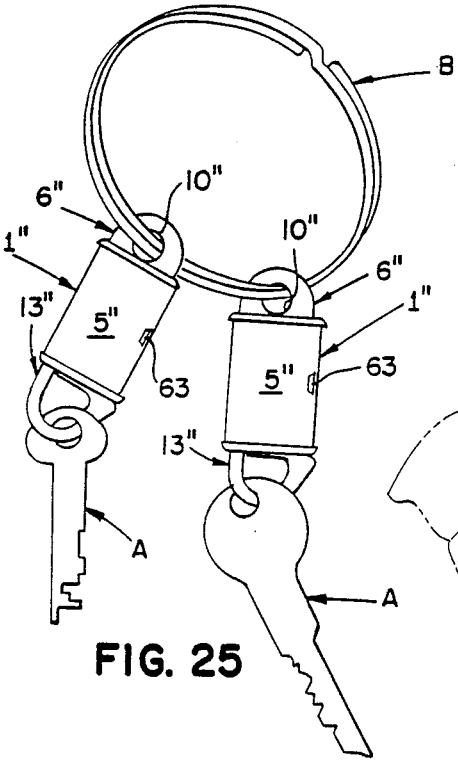
FIG. 25 is a plan view of the device shown in FIG. 20 attached to a split ring holder.
Figure 26:
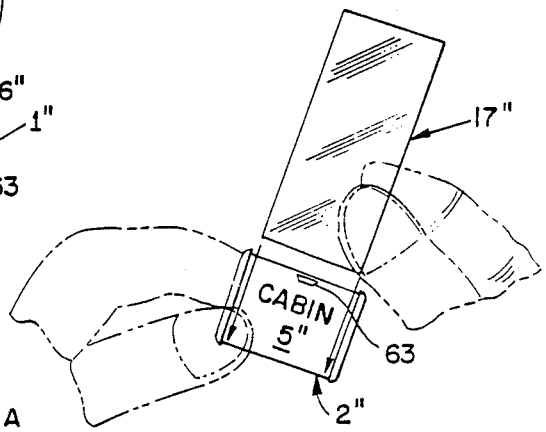
FIG. 26 is a plan view of a portion of the device of FIG. 20 with a piece of plastic protective tape. Portions of human fingers are shown in broken line to illustrate the ease of affixing the plastic tape to the device.

As illustrated in FIG. 25, several tag devices 1" may be grouped on a D-ring "B" by inserting a portion of the D-ring through openings 10" in the tag device 1".

A feature of all three of the forms of the invention is that larger labels in proportion to the size of the tag device may be used. While most key tags can utilize only 30 to 44 percent of the sleeve's surface area for the message, the tags of the present invention utilize 50 to 89 percent of the surface area. This results in a much more legible label. The larger message area is provided by using the entire outer circumference of the sleeve to carry the message, whereas most key tags show the message through a window that occupies only part of one side of the sleeve.

The sleeves are dimensioned to accept commercial adhesive backed paper mailing labels of any width up to one inch. The user can letter the message on the paper label portion 15', then wrap it around the indicia receiving means 5".

At the user's option, the paper label can be covered with any commercial transparent tape, up to a width of one inch, to protect the message from dirt and wear. Preferably, the user can use the elongated indicia receiving member 14' illustrated in FIG. 19 which is made of laminated paper and plastic sheet.

The tag devices can be lettered by hand, typewriter, or computer printer, then removed from the backing and wrapped around the sleeves 2". The labels can be mounted on continuous pinfeed backing; perforated for easy separation of individual labels. The labels themselves are made of adhesive backed paper and thin transparent adhesive backed plastic. Both the paper and plastic should be very thin to facilitate bending around the small radius bends of the sleeve 2" without delaminating. The labels may be sold with the tag devices as part of the package, or they may be sold separately.

It has been found by pocket wear tests that the paper labels protected by Mylar, with the edges sheltered from abrasion by the shoulders 43" and 44" are fully as durable as the cards inserted in the plastic sleeves of competing devices and they are more legible. Competing devices, most of which have soft plastic "windows" are very vulnerable to scratching which reduces their visibility very quickly.

The tag device can display significantly more information, even bar coding on the label. Most commonly available computer printers can easily apply over 200 characters of information in the 1.8 by 1 inch label area available on all three types of tag devices. A wide variety of graphic designs can also be easily made with most computer printers; many of them with color.

The tag devices are stronger and more durable than existing key tags due to the use of high strength polycarbonate plastic for the insert 6" and sleeve 2" and stainless steel wire for the insert member or the form of the invention illustrated in FIGS. 1–8.

I claim:

1. A tag device for holding articles and for attachment to an organizing member comprising:
   a. an open ended rigid sleeve having inner and outer walls and having an indicia receiving means on a portion of said outer wall;
   b. an elongated insert member having first and second ends and dimensioned for receipt within said inner wall of said rigid sleeve and retained by said rigid sleeve;
   c. article holding means on said first end of said insert member;
   d. organizer member holding means on said second end of said insert member;
   e. locking means for preventing movement of said insert member relative to said sleeve;
   f. openable gate means provided on said insert member;
   g. means formed in said open ended rigid sleeve and said elongated insert member preventing said elongated insert member from moving relative to said open ended rigid sleeve beyond a selected relative position in one direction only.

2. A tag device as described in claim 1 comprising:
   a. an elongated indicia receiving member dimensioned for placement on said indicia receiving means on said open ended rigid sleeve; and
   b. means for adhering said elongated indicia receiving member to said open ended rigid sleeve.

3. A tag device as described in claim 1 comprising:
   a. said portion of said outer wall of said rigid sleeve includes a relatively planar surface;
   b. said elongated insert member is constructed from spring metal wire;
   c. said article holding means on said first end of said insert member consists of a loop in said spring metal wire; and
   d. said locking means for preventing movement of said insert member relative to said sleeve consists of a shoulder on said inner wall of said sleeve.

4. A tag device as described in claim 1 comprising:
   a. said means formed in said open ended rigid sleeve is formed with a first end dimensioned for receiving said insert member and a second end formed with a restriction preventing passage of said insert member therethrough.

5. A tag device as described in claim 1 comprising:

a. said insert member is constructed from a single piece of spring metal wire formed into first and second rounded ends generally parallel sides and first and second diverging portions connected to said first rounded end and extending along a substantial portion of each of said sides.

6. A tag device for holding articles and for attachment to an organizing member comprising:

a. an open ended rigid sleeve having inner and outer walls and having an indicia receiving means on a portion of said outer wall;

b. an elongated insert member having first and second ends and dimensioned for receipt within said inner wall of said rigid sleeve and retained by said rigid sleeve;

c. article holding means on said first end of said insert member;

d. organizer member holding means on said second end of said insert member;

e. locking means for preventing movement of said insert member relative to said sleeve;

f. openable gate means provided on said insert member;

g. said insert member is constructed from a single piece of spring metal wire formed into first and second rounded ends and generally parallel sides and said opposite ends of said insert member extend along a substantial portion of each of said sides; and h. said open ended rigid sleeve is formed with a pair of openings in registration with said opposite ends of said insert member dimensioned to receive a tool for bending said opposite ends inwardly for removing said elongated insert member from said open ended rigid sleeve.

7. A tag device comprising:

a. an open ended rigid sleeve having first and second ends, inner and outer walls, and an indicia receiving means on a portion of said outer wall;

b. an elongated insert member having first and second ends and including a spring latch member releasably engaging said second end of said rigid sleeve for preventing movement of said insert member relative to said sleeve in one direction;

c. article holding means on said first end of said insert member;

d. organizer member holding means on said second end of said insert member;

e. openable gate means provided on said first end of said insert member; and f. means formed in said open ended rigid sleeve and said elongated insert member preventing said elongated insert member from moving relative to said open ended rigid sleeve beyond a selected relative position in one direction only.

8. A tag device as described in claim 7 comprising:

a. an elongated indicia receiving member dimensioned for placement on said indicia receiving means on said open ended rigid sleeve.

9. A tag device as described in claim 7 comprising:

a. a cam surface member mounted on said second end of said insert member.

10. A tag device comprising:

a. an open ended rigid sleeve having inner and outer walls and formed with an indicia receiving means formed in said outer wall and a catch means formed in said inner wall;

b. an elongated insert member having first and second ends releasably retained by and separable from said rigid sleeve;

c. article holding means on said first end of said insert member;

d. a spring latch member mounted on said elongated insert member having a spur for engagement with said catch means for preventing movement of said insert member relative to said sleeve;

e. openable gate means provided on said first end of said insert member; and f. means formed in said open ended rigid sleeve and said elongated insert member preventing said elongated insert member from moving relative to said open ended rigid sleeve beyond a selected relative position in one direction only.

11. A tag device as described in claim 10 including;

a. an opening formed in said rigid sleeve member in registration with said spring latch member when said insert member is inserted into said rigid sleeve member and dimensioned for receiving a tool for unlatching said latch member and permitting separation of said rigid sleeve member and said insert member.

12. A tag device as described in claim 11 comprising:

a. an elongated strip member dimensioned for placement on said outer wall of said open ended rigid sleeve and covering said opening formed in said rigid sleeve member; and b. means for adhering said elongated strip member to said open ended rigid sleeve.

* * * * *